US005555185A

United States Patent [19]

Landa

[11] Patent Number: 5,555,185

[45] Date of Patent: Sep. 10, 1996

[54] METHOD AND APPARATUS FOR IMAGING USING AN INTERMEDIATE TRANSFER MEMBER

[75] Inventor: Benzion Landa, Edmonton, Canada

[73] Assignee: Indigo N.V., SM Veldhoven, Netherlands

[21] Appl. No.: 400,717

[22] Filed: Aug. 30, 1989

Related U.S. Application Data

[63] Continuation-in-part of Ser. No. 293,456, Jan. 4, 1989.

[30] Foreign Application Priority Data

Sep. 8, 1988 [GB] United Kingdom ..... 8821180
Oct. 4, 1988 [GB] United Kingdom ..... 8823256

[51] Int. Cl.[6] ..... G03G 15/10

[52] U.S. Cl. ..... 355/256; 355/279; 430/126

[58] Field of Search ..... 355/256, 271, 355/273, 277, 279, 286; 219/216, 469, 470; 430/126

[56] References Cited

U.S. PATENT DOCUMENTS

| | | | |
|---|---|---|---|
| 3,318,212 | 5/1967 | Rubin | 355/281 |
| 3,591,276 | 7/1971 | Byrne | 430/126 |
| 3,669,706 | 6/1972 | Sanders et al. | 430/126 |
| 3,809,854 | 5/1974 | Sanders | 219/216 |
| 3,838,919 | 10/1974 | Takahashi | 355/271 X |
| 3,839,032 | 10/1974 | Smith et al. . | |
| 3,851,964 | 12/1974 | Smith et al. | 355/280 |
| 3,893,761 | 7/1975 | Buchan et al. | 355/272 |
| 4,015,027 | 3/1977 | Buchan et al. | 427/22 |
| 4,411,976 | 10/1983 | Landa et al. | 430/114 |
| 4,518,976 | 5/1985 | Tarumi et al. | 355/279 X |
| 4,585,319 | 4/1986 | Okamoto et al. | 355/200 |
| 4,684,238 | 8/1987 | Till et al. | 355/275 |
| 4,690,539 | 9/1987 | Radulski et al. | 355/256 X |
| 4,754,294 | 6/1988 | Kato | 346/160 |

FOREIGN PATENT DOCUMENTS

| | | |
|---|---|---|
| 56-123583 | 9/1981 | Japan . |
| 2027640 | 2/1980 | United Kingdom . |
| 2169416 | 7/1986 | United Kingdom . |

OTHER PUBLICATIONS

English Language Abstract of JP–56–123583.
English Language Abstract of JP–59–30571.
English Language Abstract of JP–55–164855.
English Language Abstract of JP–59–189381.
IBM Bulletin vol. 21. No. 7.
E.P.O. Search Report.

*Primary Examiner*—Joan H. Pendegrass
*Attorney, Agent, or Firm*—Greenblum & Bernstein P.L.C.

[57] ABSTRACT

Method and apparatus for transfer of a liquid toner image, containing carrier liquid and toner particles which solvate the carrier liquid at a solvation temperature above room temperature, from an image bearing surface to a substrate, the apparatus including an intermediate transfer member positioned in operative association with the image bearing surface, transferring the image from the image bearing surface onto the intermediate transfer member, and heating the image on the intermediate transfer member to a temperature above the solvation temperature, below the melting point of the toner particles and below the boiling point of the carrier liquid prior to transfer of the image to the substrate so as to cause the image to adhere to the substrate.

20 Claims, 7 Drawing Sheets

METHOD AND APPARATUS FOR IMAGING USING AN INTERMEDIATE TRANSFER MEMBER

RELATED APPLICATION

This application is a continuation-in-part application of copending application Ser. No. 293,456 filed Jan. 4, 1989.

FIELD OF THE INVENTION

The present invention relates generally to imaging apparatus and techniques and more particularly to apparatus and techniques for transfer of images from an image-bearing surface to a substrate via an intermediate transfer medium.

BACKGROUND OF THE INVENTION

Various techniques for electrostatic image transfer are known in the patent literature. U.S. Pat. No. 4,684,238 describes intermediate transfer apparatus in which a plurality of liquid images, which include a liquid carrier having toner particles dispersed therein, are attracted from a photoconductive member to an intermediate belt. Liquid carrier is removed from the intermediate belt by vacuum apparatus and the toner particles are compacted on the intermediate belt in image configuration. Thereafter, the toner particles are transferred from the intermediate belt to the copy sheet in image configuration by electrostatic attraction.

U.S. Pat. No. 4,690,539 shows a system similar to that shown in U.S. Pat. No. 4,684,238 which is suitable for multicolor multiple-pass electrophoretic image transfer.

In U.S. Pat. Nos. 3,318,212 and 3,893,761 there are described methods and devices in which a powder image being transported on a resiliently deformable intermediate support surface is softened and thus rendered sticky while present on that surface and then is transferred and fixed onto a paper receiving support under the influence of pressure.

U.S. Pat. No. 4,015,027 describes an electrophotographic toner transfer and fusing method wherein a heated roller or belt is employed for pressure transfer of dry toner images from an intermediate transfer medium onto paper. At column 11, line 29—column 12 line 38 there appears a detailed discussion of heating of images upon transfer thereof as proposed therein and as taught in the prior art including specifically U.S. Pat. No. 3,591,276 to Byrne.

Reference is made to FIGS. 5A–5C, 6A–6C, 7A and 7C of U.S. Pat. No. 4,015,027. It is seen that in nearly all cases described, the toner is heated to at least its melting point during the transfer stage. In a technique proposed in U.S. Pat. No. 4,015,027 and exemplified by FIG. 6(*a*), the toner is heated to at least its melting point prior to the transfer zone. In the transfer zone, the toner cools below its melting point during transfer and fusion.

A belt construction characterized in that it has a very low heat capacitance and a thickness of between 15 and about 200 microns is proposed in U.S. Pat. No. 4,015,027. In one embodiment the belt comprises a 50 micron layer of aluminized Kapton having a 25 micron coating of silicon rubber. Another embodiment employs a 12.5 micron layer of stainless steel instead of the Kapton together with a silicon rubber coating. A reflecting layer is incorporated in the belt to reduce heating thereof.

U.S. Pat. No. 4,796,048 describes a system for transferring a liquid toner image from a photoconductive member to an intermediate transfer member for subsequent transfer to a copy sheet. In several of the examples the liquid toner image is heated to remove solvent associated with the toner image. The toner particles are melted to thermally offset the image to the copy sheet.

U.S. Pat. No. 4,708,460 describes a system for transferring a liquid toner image from a photoconductive member to an intermediate transfer member for subsequent transfer to a copy sheet. The liquid toner image is heated by radiant heat on the intermediate transfer member to vaporize some of the liquid carrier and to partially melt the toner particles, decreasing their viscosity. During transfer to the final substrate heat substantially vaporizes the remainder of the liquid carrier from the image and fuses the image to the copy sheet.

SUMMARY OF THE INVENTION

The present invention seeks to provide improved imaging apparatus.

There is therefor provided apparatus for transfer of a liquid toner image (containing carrier liquid and toner particles which solvate said carrier liquid at a solvation temperature above room temperature) from an image bearing surface to a substrate, the apparatus comprising: an intermediate transfer member arranged in operative association with the image bearing surface, first transfer means operative for transferring the image from the image bearing surface onto the intermediate transfer member, and heating apparatus operative for heating the image on the intermediate transfer member to a temperature above the solvation temperature, below the melting point of the toner particles and below the boiling point of the carrier liquid prior to transfer of the image to the substrate so as to cause the image to adhere to said substrate.

In accordance with a preferred embodiment of the invention the apparatus also comprises second transfer means operative for transferring the heated image from the intermediate transfer member to a substrate, the second transfer means being operative for cooling the intermediate transfer member sufficiently such that the adhesion of the image thereto is less than the cohesion of the image. In a preferred embodiment of the invention the second transfer means in conjunction with the substrate is operative to cool the image sufficiently such that the adhesion of the image to the intermediate transfer member is less than the cohesion of the image.

The first transfer means includes, in a preferred embodiment of the invention, apparatus for transferring multiple images from the image bearing surface onto the intermediate transfer member.

In a preferred embodiment of the invention the toner particles in the liquid toner image are pigmented.

Further in a preferred embodiment of the invention the heating apparatus is operative to heat the image such that the image remains at a temperature above the solvation temperature until contact of the image with the substrate.

Further in accordance with a preferred embodiment of the invention, the intermediate transfer member comprises a thin walled cylinder preferably with a thickness of less than 125 microns. In alternative preferred embodiments the wall thickness may be less than 50, less than 30 or less than 7 microns. In a preferred embodiment of the invention the thin walled cylinder includes metallic material. In a preferred embodiment the thin walled cylinder comprises a layer of polymer material and a thin release layer.

In a preferred embodiment of the invention, the intermediate transfer member includes a relatively heat conductive inner layer and a relatively heat insulative outer layer.

In a preferred embodiment of the invention the intermediate transfer member has a low effective heat capacity such that the surface temperature of the intermediate transfer member is substantially reduced during transfer of an image therefrom onto substrate.

There is additionally provided a method for transfer of a liquid toner image (containing carrier liquid and toner particles which solvate the carrier liquid at a solvation temperature above room temperature) from an image bearing surface to a substrate, including the steps of: transferring the image from the image bearing surface onto an intermediate transfer member, and heating the image on the intermediate transfer member to a temperature above the solvation temperature, below the melting point of the toner particles and below the boiling point of said carrier liquid prior to transfer of the image to the substrate so as to cause the image to adhere to the substrate.

The method includes, in a preferred embodiment of the invention, the step of cooling the intermediate transfer member sufficiently such that the adhesion of the image thereto is less than the cohesion of the image. In a preferred embodiment of the invention the image is cooled sufficiently such that the adhesion of the image to the intermediate transfer member is less than the cohesion of the image.

In a preferred embodiment of the invention the step of transferring the image from the image bearing surface is repeated a plurality of times, each transfer corresponding to an image of a different color.

The method preferably includes the step of transferring the heated image from the intermediate transfer member to the substrate, wherein the step of transferring the image from the intermediate transfer member onto the substrate is operative to cool the image to below the solvation temperature.

BRIEF DESCRIPTION OF THE DRAWINGS

The present invention will be understood and appreciated more fully from the following detailed description taken in conjunction with the drawings in which.

DETAILED DESCRIPTION OF THE INVENTION

Figure 1:
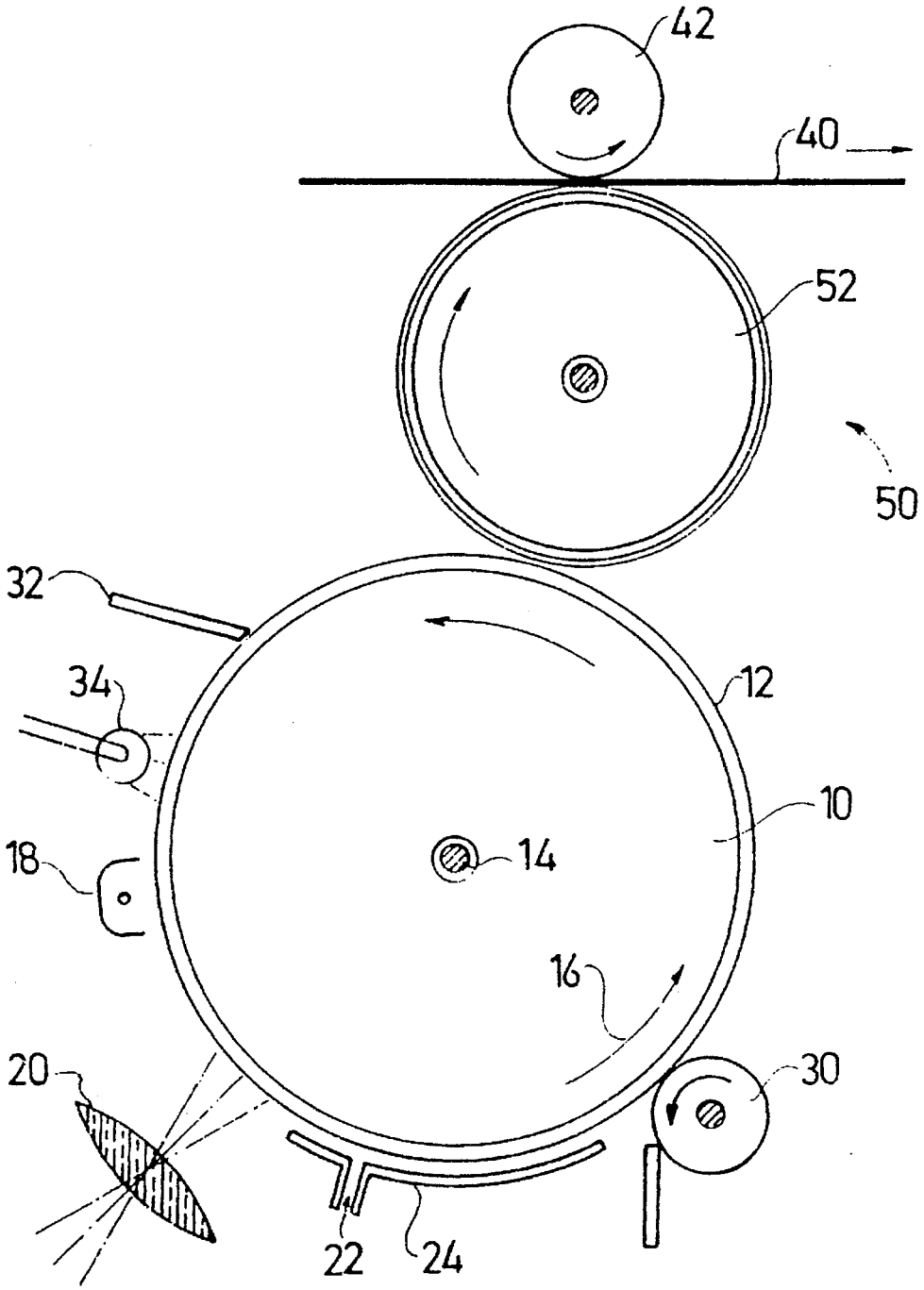
FIG. 1 is a generalized schematic sectional illustration of imaging apparatus constructed and operative in accordance with a preferred embodiment of the present invention.

Referring to FIG. 1 there is shown electrostatographic imaging apparatus in which the present invention may be employed and employing a liquid image forming composition. In a general sense, the imaging apparatus may comprise an electrostatographic printing machine or alternatively any other suitable type of imaging apparatus. Examples of systems in which the present invention may be employed include electrophotography, electrography, ionography, xero-printing, gravure-like printing and electrostatic printing.

For convenience, the description which follows is presented in the context of an electrophotographic system employing liquid toner, but without limiting the applicability of the present invention.

A metal drum 10, having formed thereon a photoconductive surface 12, is mounted on a shaft 14. Drum 10 is driven in the direction of arrow 16 such that the photoconductive surface 12 moves past a corona discharge device 18 adapted to charge the photoconductive surface 12. An image to be reproduced is focused by a lens 20 upon the photoconductive surface 12. The areas of the photoconductive surface 12 struck by light conduct the charge, or a portion thereof, to ground, thus forming an electrostatic latent image.

Developer liquid containing pigmented particles is circulated from any suitable source into a gap 22 defined between a development electrode 24 and the photoconductive surface 12. The development electrode 24 may be appropriately biased as known to the art, to assist in toning the electrostatic latent image as it passes into contact with the developer liquid.

Charged toner particles suspended in a carrier liquid, both of which form part of the developer liquid, travel by electrophoresis to the electrostatic latent image.

Excess liquid is removed from the developed image by metering apparatus which may incorporate a reverse roller indicated generally at reference numeral 30.

Transfer of the image to a carrier sheet 40, such as paper, supported by a platen roller 42, is effected by an intermediate transfer assembly 50 which is a subject of the present invention.

The transfer assembly 50 comprises an intermediate transfer element 52, typically in the form of a cylindrical roller. The intermediate transfer element 52 is preferably an intermediate transfer element of the type illustrated in any of FIGS. 4A–7B.

Transfer of the image from the photoconductive surface 12 to the intermediate transfer element 52 may take place in accordance with any suitable technique known in the prior art. Examples of suitable techniques are electrostatic transfer, heat transfer, pressure transfer, electrophoretic transfer and combinations thereof. A preferred transfer method is electrophoretic transfer.

After the image is transferred from the photoconductive surface 12 to the intermediate transfer element 52, continued rotation of the photoconductive surface 12 in the direction of arrow 16 brings the surface past a conventional cleaning station 32 and a flood exposure light 34, for removing vestiges of prior images.

In accordance with a preferred embodiment of the invention the liquid toner image is heated on the intermediate transfer member 52. Heating of the image enhances its cohesiveness and renders it tacky, so as to enhance its adhesion to the substrate 40.

Although the invention is not limited in its application to specific materials or to liquid toner, the following specific example is provided for the purposes of illustration. There is employed a toner which is prepared in the following manner:

1000 g. Elvax II 5550 resin (DuPont) and 500 g. Isopar L were mixed in a Ross double planetary mixer for one hour at 90 degrees C, then for a further hour after addition of 250 g. Mogul L carbon black (Cabot) which had been wetted by 500 g. Isopar L, and finally for another hour after addition of 2000 g. Isopar L preheated to 110 degrees C. Stirring was continued in the absence of heating until the temperature reached 40 degrees C. 3050 grams of the resultant mixture was milled in a Sweco M-18 vibratory mill (containing 0.5" alumina cylinders) with 4000 g. Isopar L for 20 hours at 34 degrees C; the average particle size of the product was 2.3 microns. The product was diluted to a 1.5% solids content with Isopar L and between 5–20 ml of 10% Lecithin charge director was added to the diluted dispersion.

Figure 2A:
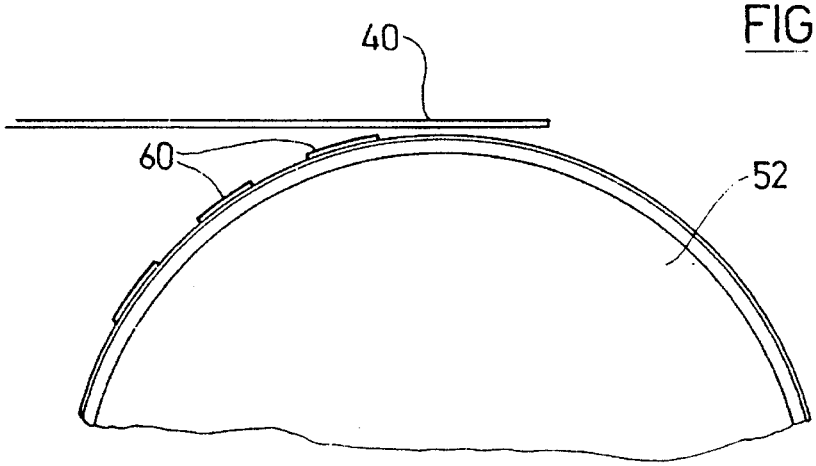
FIGS. 2A, 2B and 2C are illustrations of transfer of an image from an intermediate transfer element onto a substrate.

The image 60 located on the intermediate transfer element 52 is heated, by means which will be described hereinbelow, to a temperature which produces desired tackiness of the image. Then the heated image establishes contact with the substrate 40 as shown in FIG. 2A.

According to a preferred embodiment of the present invention, wherein a toner of the type described in detail on the preceding page, a toner of the type described in U.S. Pat. No. 4,794,651, the contents of which are hereby incorporated herein by reference, or any other liquid toner which solvates at a temperature below its melting point is used, the image 60 is heated to a temperature below the melting point of the dry resin but above the temperature at which the resin swells or begins to solvate with the carrier liquid and becomes tacky, and below the boiling point of the carrier liquid. Alternatively a liquid toner which does not solvate at a temperature below the melting point of the pigmented solid particles therein may be employed. In such a case, heating of the image to a temperature as high as the melting point of the pigmented solid particles therein is required.

Figure 2B:
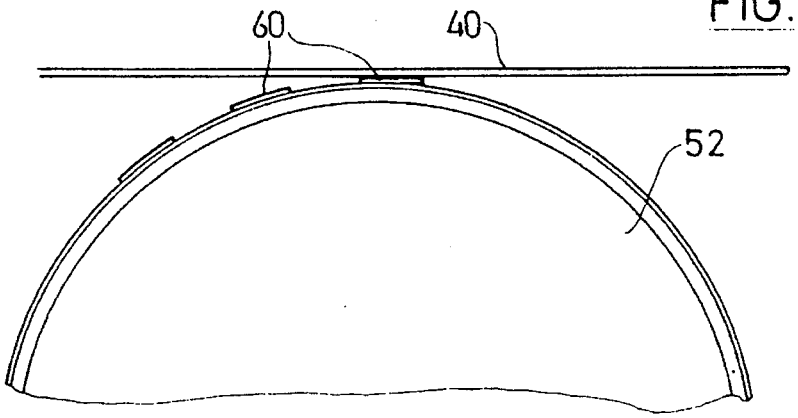
Figure 2C:
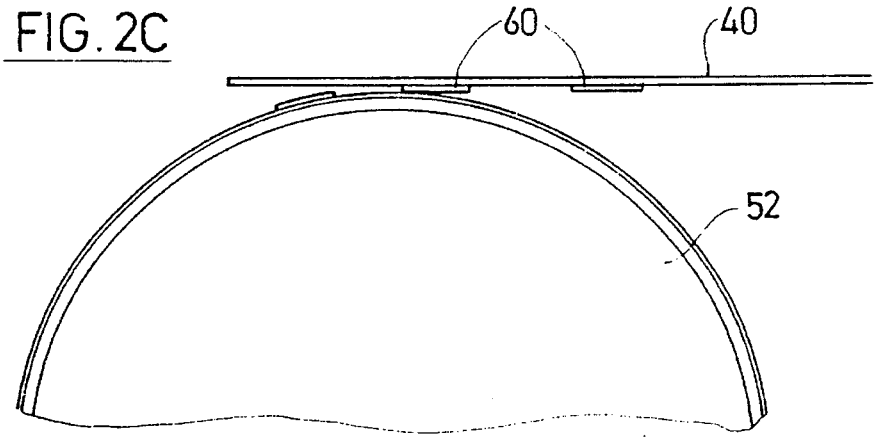

It is a particular feature of the present invention that while the image 60 is in contact with both the element 52 and the substrate 40, as shown in FIG. 2B, for a duration which will be termed the "transfer duration" the heat transfer to the image from the element 52 and from the image to the substrate 40 is preferably such that the image is cooled, so as to increase its viscosity, while at least maintaining and preferably increasing its cohesiveness. In this way, complete or nearly complete transfer of the image from the intermediate transfer element 52 to the substrate is realized. FIG. 2C illustrates the complete or nearly complete transfer of the image to the substrate 40.

If the specific material discussed above is employed as an example, the following exemplary temperatures may be used. The image 60 and member 52 are initially heated to a temperature T 1 of 105 degrees C, which is below the melting point of the resin but above the solvation temperature. During the "transfer duration" the temperature of the image/paper interface is reduced to a temperature T 2 of 85 degrees C, at which the viscosity is increased over that at the higher temperature.

Figure 3:
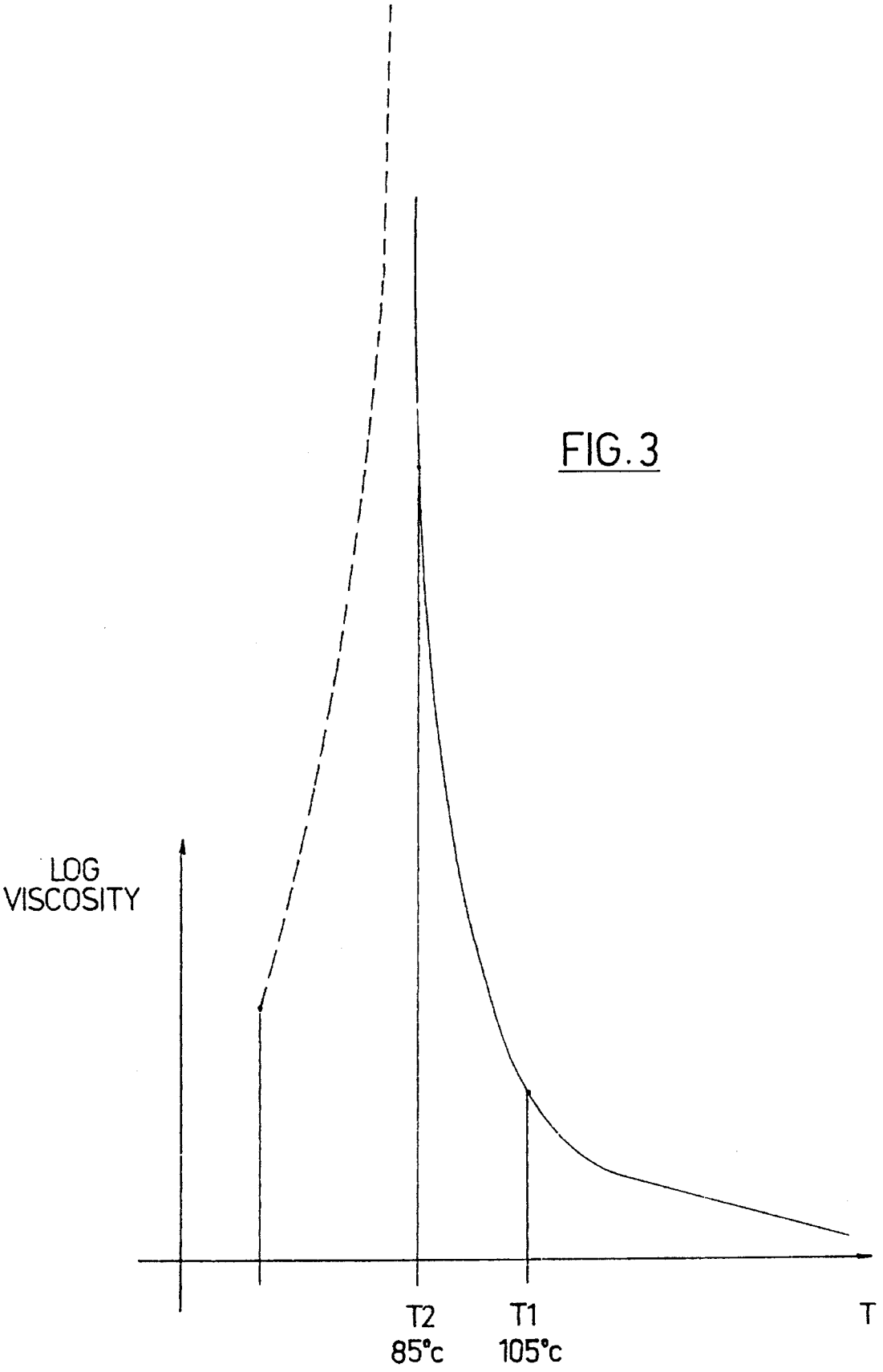
FIG. 3 is a generalized illustration of viscosity as a function of temperature.

Reference is made in this context to FIG. 3 which is an illustration, not necessarily to scale, of the dependence of viscosity of an image on temperature. It is seen that the reduction of temperature from T 1 to T 2 provides a corresponding significant rise in viscosity.

It will be appreciated that the image is initially heated to a temperature at which it solvates, so that it will adhere well to the substrate. The image is then cooled, increasing its viscosity and thus increasing its cohesiveness. The adhesion of the image to the substrate is greater than its adhesion to the release coated intermediate transfer member, and the increased cohesion of the image preserves the integrity of the transferred image, providing substantially complete transfer of the image to the substrate.

Reference is now made to FIGS. 4A–7B which illustrate four alternative embodiments of intermediate transfer elements constructed and operative in accordance with a preferred embodiment of the invention.

According to a preferred embodiment of the invention, the intermediate transfer element comprises a thin-walled roller 70. Roller 70 preferably is formed of two rigid end portions 72 and 74 and a thin cylindrical layer 76 typically coated with a release layer 78. Typical materials and thicknesses are as follows:

Layer 76: metalized polyester

Thickness: 25 microns

Release layer 78: Teflon (DuPont)

Thickness: 5 microns

According to an alternative embodiment of the invention, the layer 76 may be a 5 micron thick film of nickel alloy, such as a nickel cobalt or nickel chromium alloy and the release layer may be a 2 micron thick layer of Teflon.

According to a further alternative embodiment of the invention, Kapton polyimide film (DuPont) may be employed instead of polyester.

According to a further alternative embodiment of the invention the release layer may be a thin layer of silicone rubber.

In accordance with a preferred embodiment of the invention, the thin cylindrical layer 76 is axially tensioned, as by a spring arrangement 80, sufficient to eliminate most surface irregularities. For the abovedescribed example employing metalized polyester, for a cylinder of diameter 50 mm, a suitable tension is 10 Kg.

Further in accordance with a preferred embodiment of the invention, enhanced rigidity and surface uniformity of the thin-walled cylinder 70 is provided by pneumatically pressurizing the interior of the cylinder, by any suitable pressurized gas. A valve 82 may be provided for this purpose.

In accordance with a preferred embodiment of the present invention, the thin-walled cylinder 70 is heated by the passage of electrical current along layer 76 via conductors 84 and 86, which establish an electrical circuit via end portions 72 and 74. In this case layer 76 must either be or include a layer which is an electrical conductor of suitable characteristics.

In the above stated example, the electrical power required to provide desired heating of the intermediate transfer element 70 is relatively low.

Figure 5A:
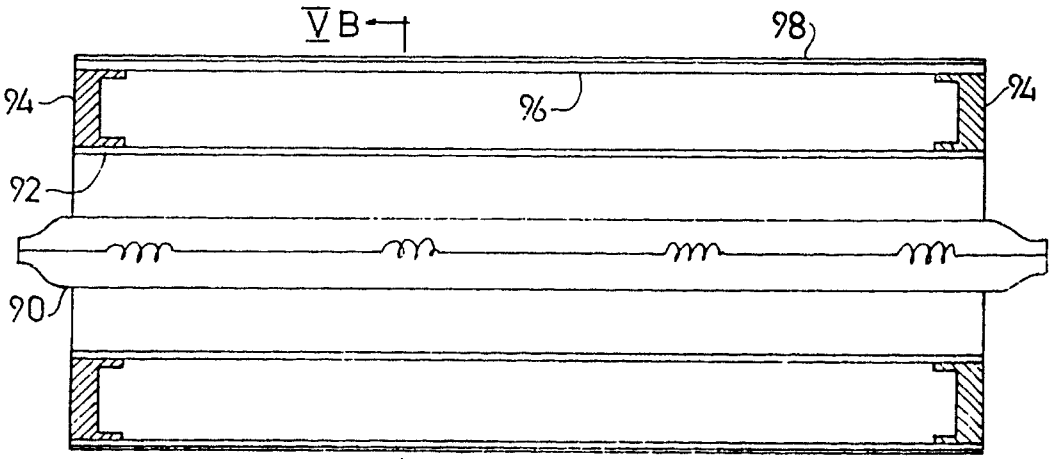
FIG. 5A is a side sectional illustration of a heated thin-walled intermediate transfer element constructed and operative in accordance with an alternative embodiment of the present invention.
Figure 5B:
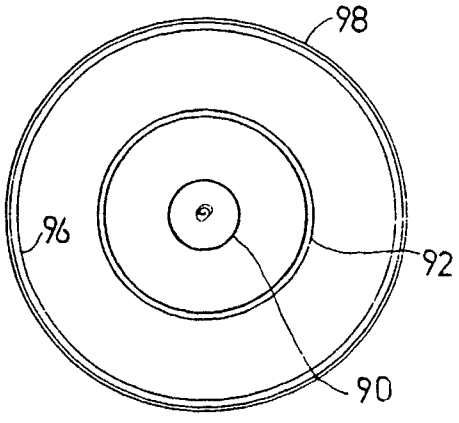
FIG. 5B is a sectional illustration taken along the lines V—V of FIG. 5A.

Reference is now made to FIGS. 5A and 5B which illustrate an alternative embodiment of a heated intermediate transfer element wherein heating is provided by radiation. Here a heating lamp 90 is disposed interior of a radiation transmissive tube 92, such as a quartz tube. Disposed in generally coaxial surrounding relationship with quartz tube 92 and supported on annular end supports 94 is an intermediate transfer layer 96 having formed thereon a release layer 98.

Figure 4A:
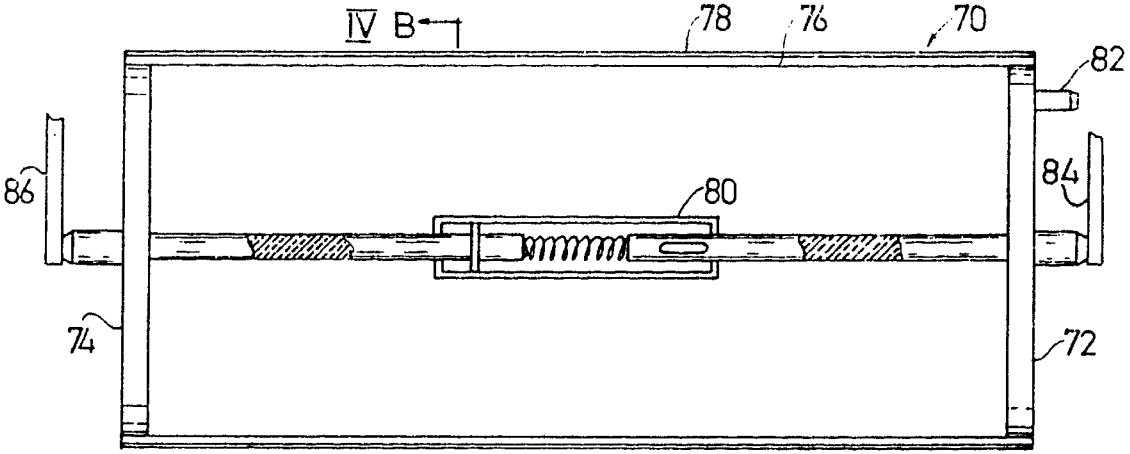
FIG. 4A is a side sectional illustration of a heated thin-walled intermediate transfer element constructed and operative in accordance with a preferred embodiment of the present invention.
Figure 4B:
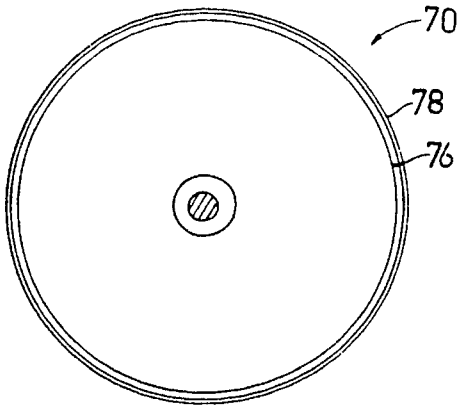
FIG. 4B is a sectional illustration taken along the lines IV—IV of FIG. 4A.

According to one embodiment of the invention, layers 96 and 98 may be identical to layers 76 and 78 in the embodiment of FIGS. 4A and 4B. In such a case tensioning apparatus of the type illustrated in FIG. 4A may be employed. Alternatively layers 96 and 98 which are more massive and thus more rigid than layers 76 and 78 may be employed. In such a case the release layer 98 is provided with sufficient thermal insulation capacity to limit the amount of thermal conduction therethrough so that during transfer of the image to the substrate 40, the image may be cooled as described above in connection with the thin-walled intermediate transfer element. Suitable materials and thicknesses for the non-thin-walled intermediate transfer element are as follows:

Layer 96: Aluminum

Thickness: 5 mm

Layer 98: Silicone rubber

Thickness: 2 mm

Figure 6A:
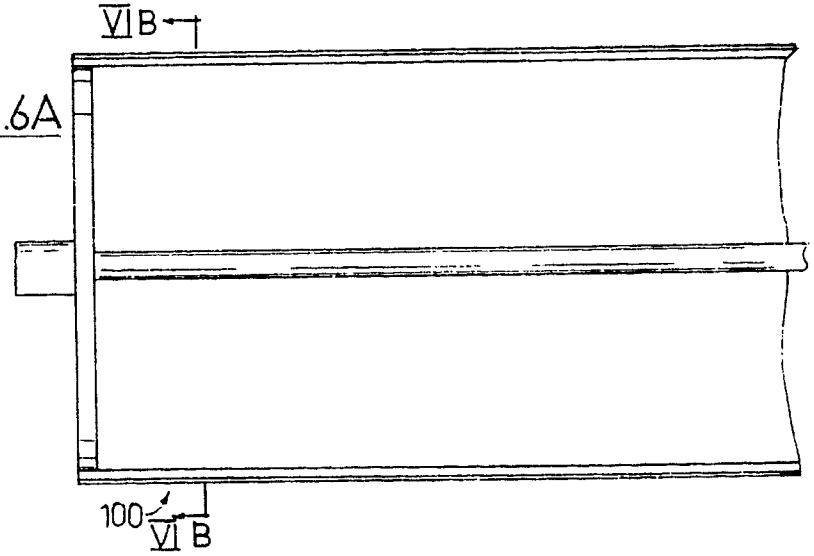
FIG. 6A is a side sectional illustration of a heated thin-walled intermediate transfer element constructed and operative in accordance with a further alternative embodiment of the present invention.
Figure 6B:
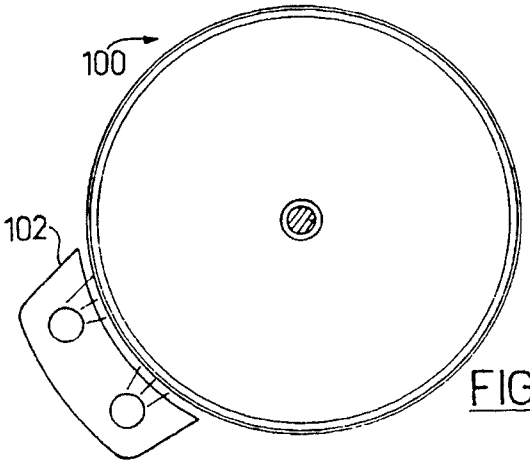
FIG. 6B is a sectional illustration taken along the lines VI—VI of FIG. 6A.

Reference is now made to FIGS. 6A and 6B, which illustrate an alternative arrangement of heated intermediate transfer roller. The roller 100 may be either of the thin-walled type or of the non-thin-walled type described above. Heating of the roller 100 is provided externally of the roller by a heating station 102. In the illustrated embodiment, the heating station 102 employs radiant heaters, which heat the roller by radiation. Alternatively the heating station 102 may heat the roller 100 by conduction through direct contact with the roller.

Figure 7A:
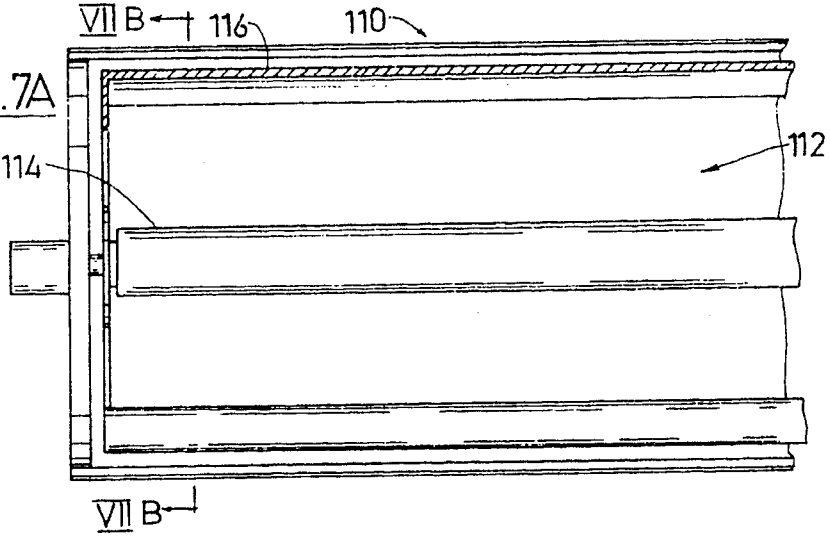
FIG. 7A is a side sectional illustration of a heated thin-walled intermediate transfer element constructed and operative in accordance with yet another embodiment of the present invention.
Figure 7B:
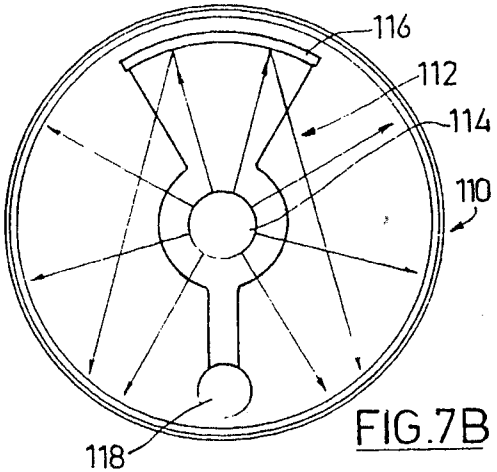
FIG. 7B is a sectional illustration taken along the lines VII—VII of FIG. 7A.

Reference is now made to FIGS. 7A and 7B, which illustrate a further alternative of heated intermediate roller arrangement. Here, once again, a roller 110 may be either thin- walled or non-thin-walled. Heating of the roller 110 is provided by an internal radiant heater assembly 112 which is mounted internally of roller 110. Radiant heater 112 comprises an elongate radiative heat source 114 which is associated with a reflector 116, which prevents direct radiation from source 114 from reaching the area at which the image is transferred from the roller 110 to substrate 40 (FIG. 1), thus providing differential heating of roller 110 and permitting cooling of the image during transfer as described hereinabove.

A suitable weight 118 may be mounted onto the reflector 116 so that when the reflector 116 and weight 118 are pivotably mounted with respect to the roller, they will retain the orientation illustrated, notwithstanding rotation of the roller 110.

It is a particular feature of the present invention that there is provided an intermediate transfer member including a thin surface which supports the image during transfer, the thin surface having an effective heat capacity per unit area which is less than that of the substrate.

The thin surface may be a cylindrical surface or alternatively an endless belt or any other configuration. Normally, due to its thinness, the thermal conductivity along the surface is sufficiently small such that the thermal mass of the supports, such as end rollers for a cylindrical surface like that shown in the drawings, may be disregarded.

It is a particular feature of the present invention that the effective thermal mass of the intermediate transfer element, as sensed by an object coming into contact with its outer surface is relatively small. This may be achieved either by the use of a thin-walled roller as described hereinabove, whose inherent thermal mass is limited, or alternatively by the use of a roller, other than a thin-walled roller, but having an outer layer which is a sufficiently good thermal insulator such that the heat transfer characteristics thereof are as required. Such a structure has been described above.

The advantages of the use of an intermediate transfer element having a low effective thermal mass are summarized below:

a. enabling the image at the transfer region of the intermediate transfer element to be cooled during transfer, as has already been described;

b. enabling rapid cooling of the intermediate transfer element and thus eliminating the need for separating it from the photoconductor when operation is interrupted;

c. limiting the amount of thermal energy passed to the paper and thus reducing energy consumption and limiting paper deformation;

d. enabling differential heating of the intermediate transfer element such that it cools down from the onset of transfer to the onset of photoconductor contact to a temperature at which contact with the photoconductor will not cause photoconductor damage.

Figure 8:
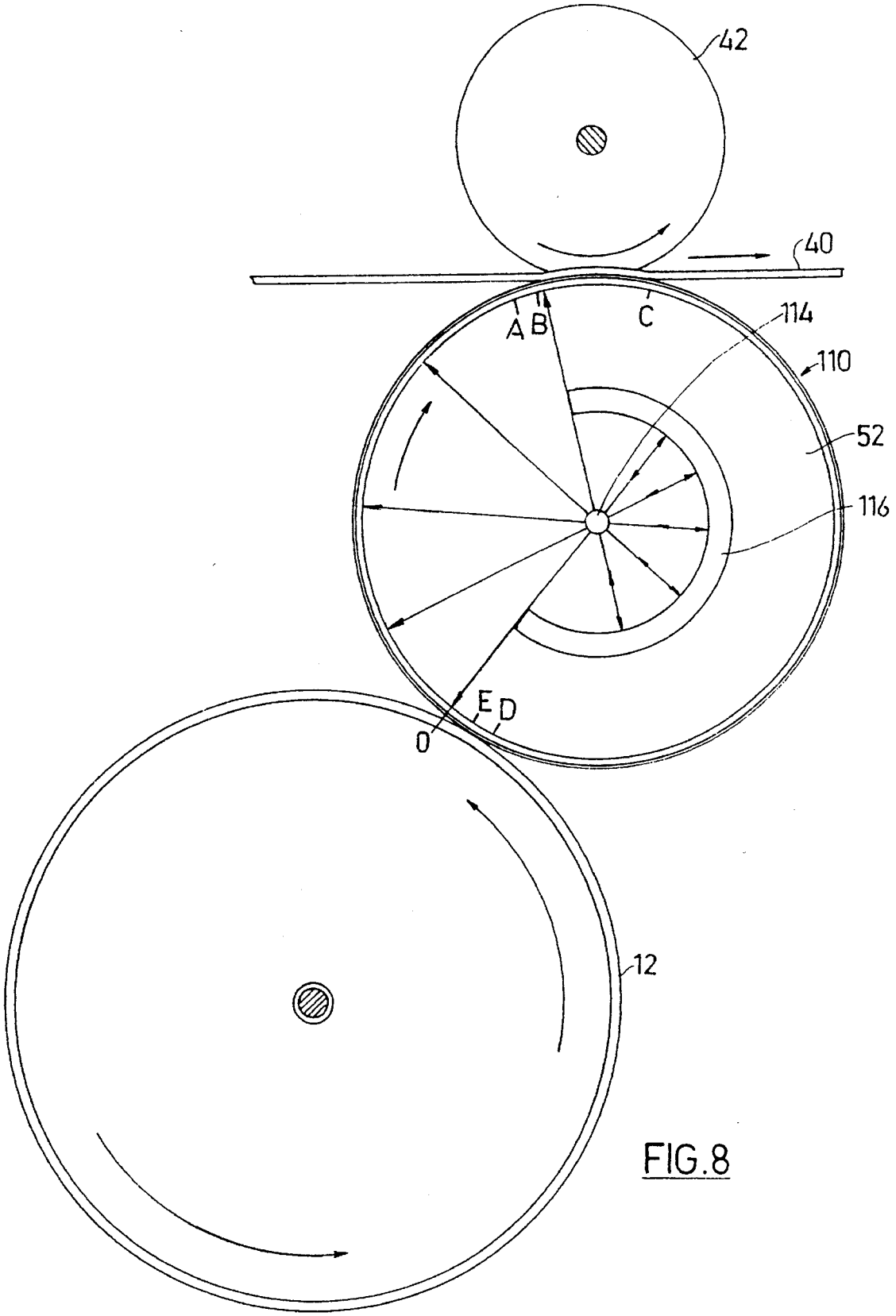
FIG. 8 is a sectional illustration of a partially heated intermediate transfer element.
Figure 9:
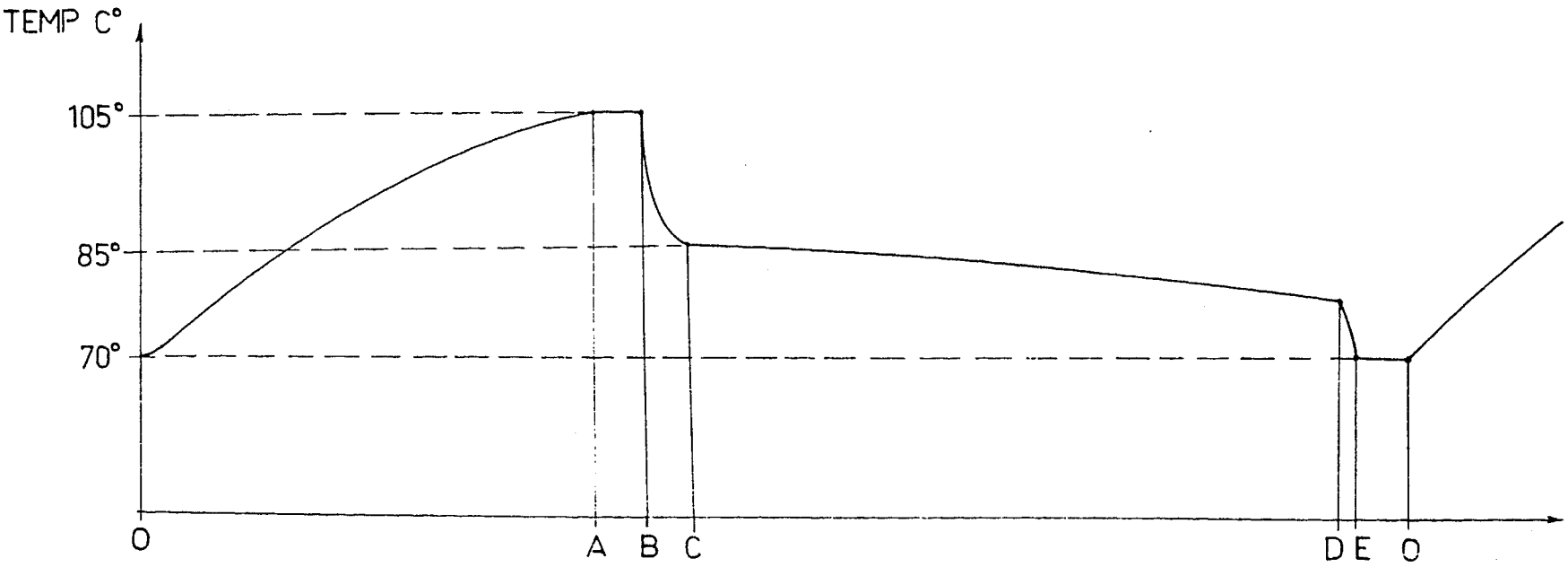
FIG. 9 is a graphical illustration of the temperature variation on a low thermal mass intermediate transfer element in an arrangement such as that illustrated in FIG. 8.

Reference is made in this context to FIG. 8 which illustrates a variation of the apparatus of FIGS. 7A and 7B, using identical reference numerals where appropriate, wherein a reflector is oriented so as to prevent direct radiation heating of the roller from the transfer stage through the photoconductor contact stage. In such a situation the approximate roller temperature at various locations thereabout is as shown in FIG. 9.

It can be seen from a consideration of FIGS. 8 and 9 that the intermediate transfer member gives up a measured quantity of heat to the substrate during image transfer thereto (between locations B and C) and remains at a relatively low temperature, i.e. below about 85 degrees centigrade, until it contacts the photoconductive surface 12, at which point it gives up further heat very quickly to the photoconductive surface 12 (between locations D and E). The photoconductive surface does not heat up appreciably in view of its relatively large thermal mass. The intermediate transfer member remains at generally the same temperature until it is exposed to radiation heating (at location 0) and is heated gradually until it reaches a steady state temperature (at location A) just before transfer contact with the substrate (at location B).

It is a particular feature of the present invention that the temperature of the intermediate transfer member when it is in propinquity to the photoconductive surface 12 is sufficiently low as to preclude damage to the photoconductive surface 12, even during prolonged contact or propinquity, as when neither of the surfaces is rotating. Accordingly prior art mechanisms for separating the intermediate transfer member from the photoconductive surface 12 when the apparatus is not in operation are not required.

It will be appreciated by persons skilled in the art that the present invention is not limited by what has been particularly shown and described hereinabove. Rather the scope of the present invention is defined only by the claims which follow:

I claim:

1. Apparatus for transfer of a liquid toner image, containing carrier liquid and toner particles which solvate said carrier liquid at a solvation temperature above room temperature, from an image bearing surface to a substrate, the apparatus comprising:

an intermediate transfer member arranged in operative association with said image bearing surface;

a transfer station operative for transferring said image from said image bearing surface onto said intermediate transfer member; and heating means operative for heating said image on said intermediate transfer member to a temperature above said solvation temperature, below the melting point of the toner particles and below the boiling point of said carrier liquid prior to transfer of the image to said substrate so as to cause the image to adhere to said substrate.

2. Apparatus according to claim 1 and comprising transfer means operative for transferring said heated image from said intermediate transfer member to said substrate, said transfer means being operative for cooling said intermediate transfer member sufficiently such that the adhesion of said image thereto is less than the cohesion of said image.

3. Apparatus according to claim 1 wherein the transfer station includes means for transferring multiple images from said image bearing surface onto said intermediate transfer member.

4. Apparatus according to claim 1 wherein said toner particles in said liquid toner image are pigmented.

5. Apparatus according to claim 1 wherein said heating means is operative to heat said image such that said image remains at a temperature above said solvation temperature until contact of said image with said substrate.

6. Apparatus according to claim 2 wherein said transfer means in conjunction with said substrate is operative to cool said image sufficiently such that the adhesion of the image to said intermediate transfer member is less than the cohesion of said image.

7. Apparatus according to claim 1 wherein said intermediate transfer member comprises a thin walled cylinder.

8. Apparatus according to claim 7 wherein said thin walled cylinder has a thickness less than 125 microns.

9. Apparatus according to claim 7 wherein said thin walled cylinder has a thickness less than about 50 microns.

10. Apparatus according to claim 7 wherein said thin walled cylinder has a thickness less than about 30 microns.

11. Apparatus according to claim 7 wherein said thin walled cylinder comprises a layer of polymer material and a thin release layer.

12. Apparatus according to claim 7 wherein said thin walled cylinder has a thickness less than about 7 microns.

13. Apparatus according to claim 7 wherein said thin walled cylinder comprises a metallic material.

14. Apparatus according to claim 1 wherein said intermediate transfer member comprises a relatively heat conductive inner layer and a relatively heat insulative outer layer.

15. Apparatus according to claim 1 and wherein said intermediate transfer member has a low effective heat capacity such that the surface temperature of said intermediate transfer member is substantially reduced during transfer of said image therefrom onto said substrate.

16. A method for transfer of a liquid toner image, containing carrier liquid and toner particles which solvate said carrier liquid at a solvation temperature above room temperature, from an image bearing surface to a substrate, comprising the steps of:

transferring said image from said image bearing surface onto an intermediate transfer member; and heating said image on said intermediate transfer member to a temperature above said solvation temperature, below the melting point of the toner particles and below the boiling point of said carrier liquid prior to transfer of said image to said substrate so as to cause said image to adhere to said substrate.

17. The method of claim 16 and including the step of cooling said intermediate transfer member sufficiently such that the adhesion of said image thereto is less than the cohesion of the image.

18. The method of claim 16 and including the step of cooling said image sufficiently such that the adhesion of said image to said intermediate transfer member is less than the cohesion of said image.

19. The method of claim 16 and wherein the step of transferring said image from said image bearing surface is repeated a plurality of times, each transfer corresponding to an image of a different color.

20. A method according to claim 16 and including the step of transferring said heated image from said intermediate transfer member to said substrate, wherein said step of transferring the image from the intermediate transfer member onto said substrate is operative to cool said image to below said solvation temperature.

* * * * *

UNITED STATES PATENT AND TRADEMARK OFFICE

CERTIFICATE OF CORRECTION

PATENT NO. : 5,555,185

DATED : September 10, 1996

INVENTOR(S) : Benzion LANDA

It is certified that error appears in the above-indentified patent and that said Letters Patent is hereby corrected as shown below:

On the cover, in section [75], "Inventor", after "Edmonton," insert ---Alberta,---.

On the cover, in section [30], "Foreign Application Priority Data", line 1, change "8821180" to ---8821180.1---.

On the cover, in section [30], "Foreign Application Priority Data", line 2, change "8823256" to ---8823256.6---.

Signed and Sealed this

Fifteenth Day of April, 1997

*Attest:*

*Attesting Officer*

BRUCE LEHMAN

*Commissioner of Patents and Trademarks*